US010745965B2

(12) United States Patent
Judkins

(10) Patent No.: US 10,745,965 B2
(45) Date of Patent: Aug. 18, 2020

(54) METHOD FOR MAKING ROLLER SHADES

(71) Applicant: Flexo Solutions, LLC, Appleton, WI (US)

(72) Inventor: Ren Judkins, Pittsburgh, PA (US)

(73) Assignee: Flexo Solutions, LLC, Appleton, WI (US)

( * ) Notice: Subject to any disclaimer, the term of this patent is extended or adjusted under 35 U.S.C. 154(b) by 157 days.

(21) Appl. No.: 15/906,279

(22) Filed: Feb. 27, 2018

(65) Prior Publication Data

US 2018/0187479 A1 Jul. 5, 2018

Related U.S. Application Data

(63) Continuation of application No. 13/348,824, filed on Jan. 12, 2012, now abandoned.

(51) Int. Cl.
*E06B 9/262* (2006.01)
*E06B 9/40* (2006.01)

(52) U.S. Cl.
CPC ..... *E06B 9/262* (2013.01); *E06B 9/40* (2013.01); *E06B 2009/2625* (2013.01); *Y10T 29/49801* (2015.01); *Y10T 29/49826* (2015.01)

(58) Field of Classification Search
CPC ..... E06B 9/262; E06B 9/40
See application file for complete search history.

(56) References Cited

U.S. PATENT DOCUMENTS 2,803,578 A 8/1957 Holland
3,384,519 A 5/1968 Froget
3,443,860 A 5/1969 Luboshez
4,019,554 A 4/1977 Rasmussen
4,732,630 A 3/1988 Schnebly
5,043,038 A * 8/1991 Colson ..... B31D 5/04 156/193
5,160,563 A 11/1992 Kutchmarek et al.
5,205,333 A 4/1993 Judkins
5,231,708 A * 8/1993 Hansen ..... A47K 3/38 160/263
5,566,734 A 10/1996 Levy et al.
5,630,898 A 5/1997 Judkins
(Continued)

FOREIGN PATENT DOCUMENTS

EP 1249572 10/2002

OTHER PUBLICATIONS

Patent Cooperative Treaty International Search Report for PCT/US2013/020787, dated Apr. 11, 2013.
(Continued)

*Primary Examiner* — Katherine W Mitchell
*Assistant Examiner* — Jeremy C Ramsey
(74) *Attorney, Agent, or Firm* — Dority & Manning, P.A.

(57) ABSTRACT

In a method for making roller shades a stack of pleated material is cut so that the length of the stack corresponds to the width of the roller shade being made. Then the edge of the material is attached to a roller so that the plurality of pleats are parallel to the longitudinal axis of the roller. Preferably the stack of pleated material has been made from strips bonded together to form tabs where the edges of adjacent fabric segments are joined together. Preferably the tabs in the panel of pleated material will be along one edge of the stack and the pleats will be along the opposite edge of the stack.

17 Claims, 4 Drawing Sheets

(56) References Cited

U.S. PATENT DOCUMENTS

| | | | | |
|---|---|---|---|---|
| 7,588,068 | B2 | 9/2009 | Colson et al. | |
| 7,779,881 | B2 | 8/2010 | Judkins et al. | |
| 2005/0019584 | A1 | 1/2005 | Tsuda et al. | |
| 2016/0167908 | A1* | 6/2016 | Cheslock ..... | B65H 35/04<br>156/227 |

OTHER PUBLICATIONS

Patent Cooperative Treaty Written Opinion of the International Searching Authority for PCT/US2013/020787, dated Apr. 11, 2013.

* cited by examiner

METHOD FOR MAKING ROLLER SHADES

CROSS-REFERENCE TO RELATED APPLICATIONS

This application is a continuation of and claims the right of priority to U.S. patent application Ser. No. 13/348,824, filed Jan. 12, 2012, the disclosure of which is hereby incorporated by reference herein in its entirety for all purposes.

FIELD OF INVENTION

The invention relates to roller shades.

BACKGROUND OF THE INVENTION

The roller shade is a well known window covering which consists of a roller about which a window covering material is wound. The window covering material typically is a vinyl or non-woven fabric, film or coated fabric where vinyl is the most common film and coating. Typically the material has been coated to provide strength to the material. Coating provides stiffness, uniform thickness and reduces stretching and edge curl. Without the coating most materials that could be used in a drape or Roman shade will stretch in the middle when fully lowered creating an hour glass appearance to the shade. Because of the coating the hand and style of fabrics is limited. Furthermore, roller shade fabrics are so specialized that they cannot be used for drapes or soft Romans.

The material used for roller shades is typically purchased by the fabricator in large rolls. A sufficient amount of material is drawn off the roll to create a shade of a desired length. If the width of the material from the roll is greater than the desired width of the shade to be manufactured the material is trimmed while or after being removed from the roll of fabric. There are many costs and problems associated with this method of making roller shades. First, the fabricator must store large rolls of material. Each roll must be hung on an axle which is stored in a rack to prevent damage to the material. If the roll is laid length wise on a flat surface over time the material will flatten over the contact area distorting the material. If the roll is stored on end and it tips the edge of the material can be damaged. Another problem with this method of manufacture is that a significant amount of waste is often created during the manufacturing process. Most windows are 3 feet, 4 feet or 6 feet in width. Consequently, a roller shade fabricator may purchase window shade material in 6 foot rolls. In the event that the fabricator receives an order for a roller shade 4 feet in width he would then have to trim 2 feet from the roll of the material which would be scrap. There is also a practical limit to the width of material which can be purchased in rolls and the storage of remnants.

Another problem with this method of manufacture is that the fabricator must have a table wide enough and long enough to handle the largest shade which the fabricator will make. Consequently, fabrication space and inventory and handling are large and difficult.

For all these reasons there is a need for a method of manufacture of roller shades which has less scrap and can make wider roller shades than the conventional practice in making roller shades. The method should use less space and require less inventory, reduce fabrication and handling costs and enable a greater variety of fabrics to be used including fabrics that can also be used for other products.

SUMMARY OF THE INVENTION

A method of making a roller shade uses symmetric stack of pleated material that preferably is made from strips. The stack preferably is 12 feet long and not more than 12 inches in width. The stack is cut along its length so that the cut piece is the width of the shade to be manufacture. Then that piece is attached to a roller. Preferably each strip is attached to an adjacent strip in the manner to form a tab, preferably a micro tab having a width which is not greater than one-eight inch. Each strip is pleated such that there is one pleat in each strip which is equidistance between the edges of the strip.

The strip is attached to the roller such that the pleats are parallel to the longitudinal axis of the roller.

After the material is attached to the roller, the pleated material is wound on the roller. I prefer to provide a follower which rides on the fabric material as it is rolled onto the roller. The roller can be mounted on the wall or in a headrail. The follower applies pressure to the material so that the material winds evenly on the roller. As a result the pleats and bonds between adjacent strips of material will remain parallel to one another and to the longitudinal axis of the roller.

The strips of material are preferably bonded with glue line or ultrasonic welding.

Other objects and advantages of the invention will become apparent from certain present preferred embodiments thereof which are disclosed in the drawings.

DESCRIPTION OF THE PREFERRED EMBODIMENTS

Figure 1:
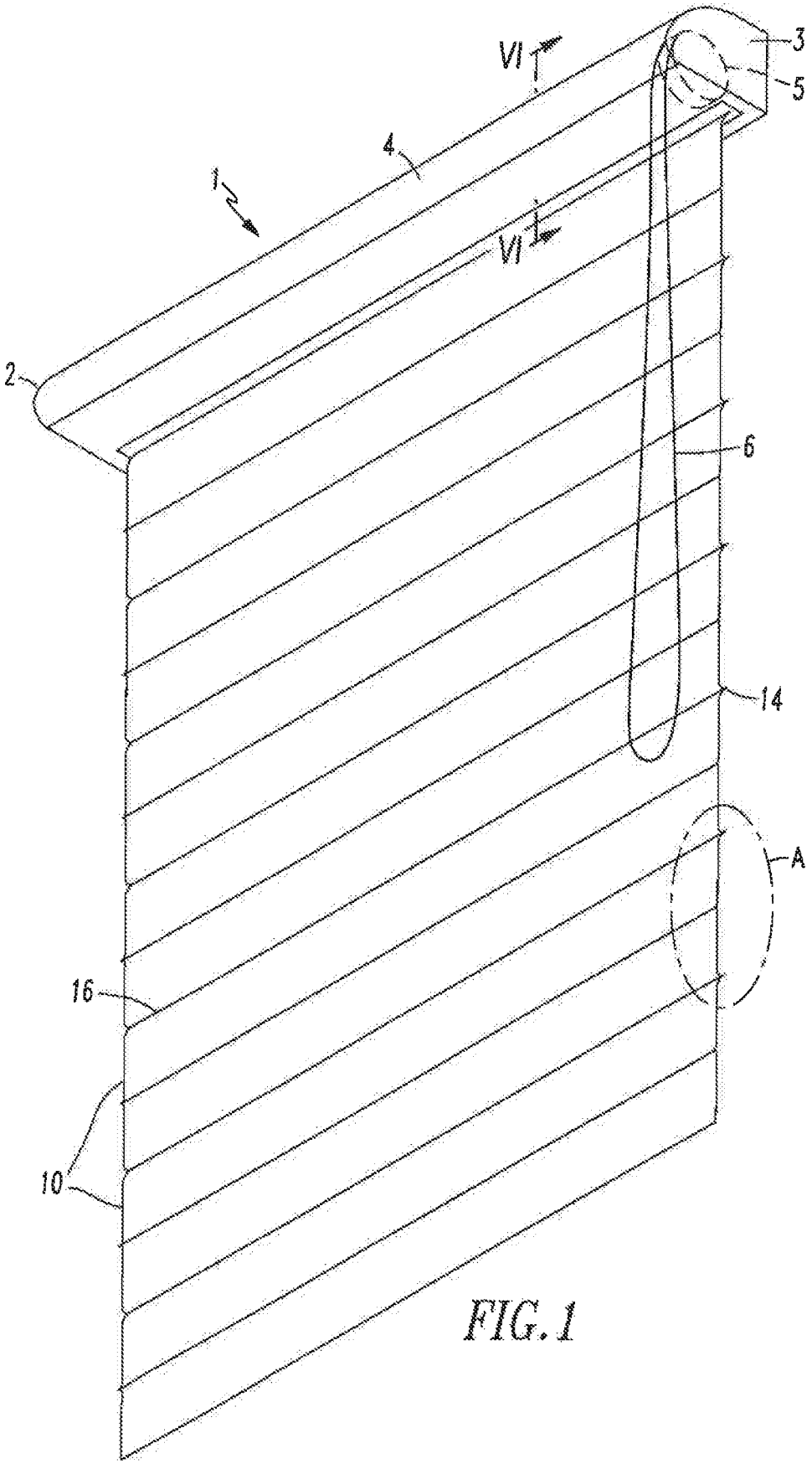
FIG. 1 is a perspective view of a roller shade made in accordance with the present method in a fully extended position.
Figure 2:
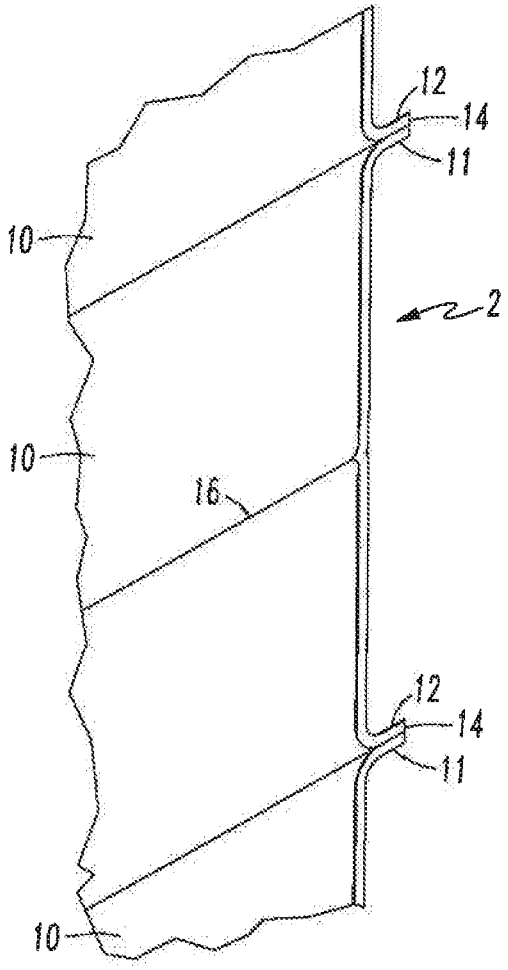
FIG. 2 is an enlarged view of the portion of the shade within the circle A in FIG. 1.
Figure 3:
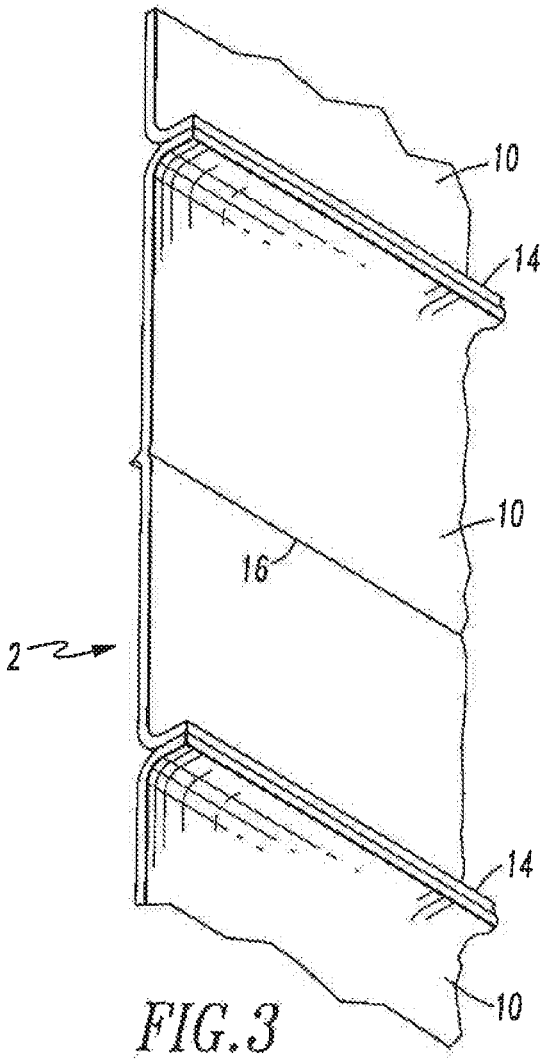
FIG. 3 is a rear perspective view of the portion of the shade shown in FIG. 2.

As can be seen most clearly in FIGS. 1 through 6, I provide a roller shade 1 which can be mounted in a headrail 4 that is placed over a window or other opening. The roller shade consists of roller 3 about which window covering material 2 is wound. The roller does not have to be mounted in a headrail, but should be wrapped tightly to develop a memory of being rolled. Some fabrics might need heat to develop a memory. I prefer to provide a loop drive 5 with cord loop 6 for raising and lowering the shade. The window covering material is made from a series of fabric, film or paper segments 10 which are attached together edge to edge, where the joined edges are perpendicular to the plane of the shade. This construction makes a permanent line and slight curvature in the fabric that is further complimented by the opposed creases in the fabric. This gives depth and character to the shade and gives it the appearance of a Roman shade. These edges 11 and 12 preferably are bonded with an adhesive, such as polyester or polyurethane, or ultrasonically welded. One could sew the edges together. However, welding and bonding with an adhesive are much more precise. Bonds can be applied with the tolerance of plus or minus 25 thousandths, whereas, stitching has a tolerance of plus or minus 50 thousandths. When the edges are bonded together, they form a tab 14. The tab should have a width of one-half inch or less. Preferably this tab is made or trimmed down to be a micro tab having a width one eighth of an inch or less. Tabs act as tiny battens redistributing stretch and opposing the natural tendency for fabric to curl toward the roller when fully deployed to cover the window. This allows fabrics not to be stiffened as much as commonly used shade material. Therefore, a greater selection of the material can be used including material that can be used for other products. The edges of the fabric segments will curve slightly as they go into the tab, giving the window covering material a three dimensional appearance rather than the flat appearance of a conventional roller shade. Each of the segments is pleated equidistant between the edges. Consequently, pleats 16 are parallel to the tabs 14. Segments of about 3, 4, 7, 10 and 12 inches are the recommended sizes in width and are bonded together and folded along the pleats and tabs to form a symmetric stack 18, shown in FIG. 4. I prefer to create a stack 12 feet in length because the widths of most shades (3 feet, 4 feet and 6 feet) are factors of 12 feet and larger widths. The wider the starting width and length the more opportunity for optimizing yield and reducing waste. Window combinations rarely require widths bigger than 12 feet and 12 feet is much larger than most materials available today.

Figure 4:
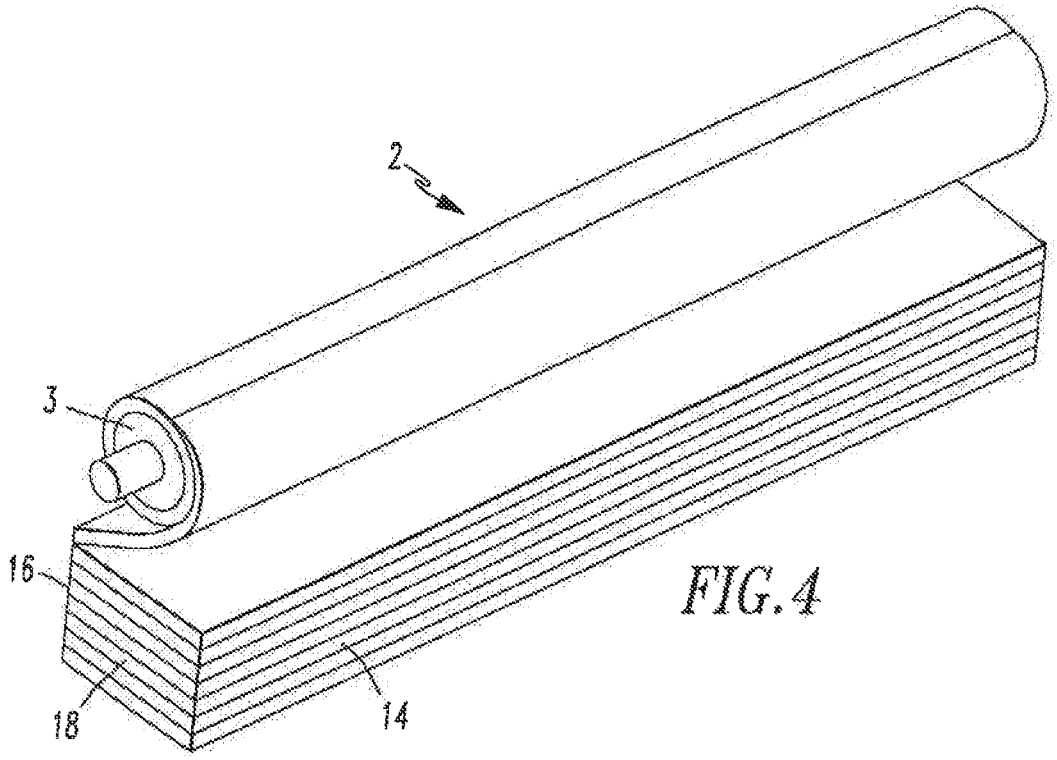
FIG. 4 is a perspective view similar to FIG. 3 showing the pleated material being attached to the roller.
Figure 5:
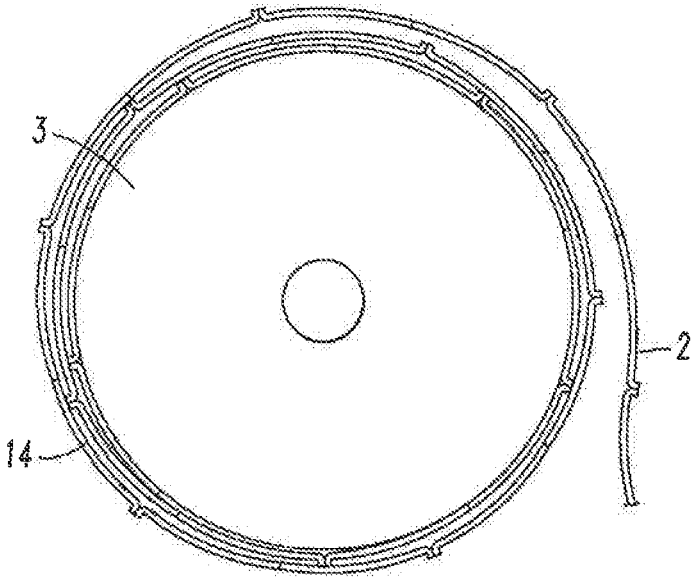
FIG. 5 is an end view of the roller shade shown in FIG. 1 in which a portion of the window covering material has been rolled onto the shade.

When the fabricator receives an order for a shade he trims the required amount of material from the stack then attaches one edge of that material to a roller as shown in FIG. 4. The fabric from the stack is then wound about the roller creating the roller shade as shown in FIG. 5. The tabs can face toward the roller or preferably face away from the roller as shown in FIG. 5

Figure 6:
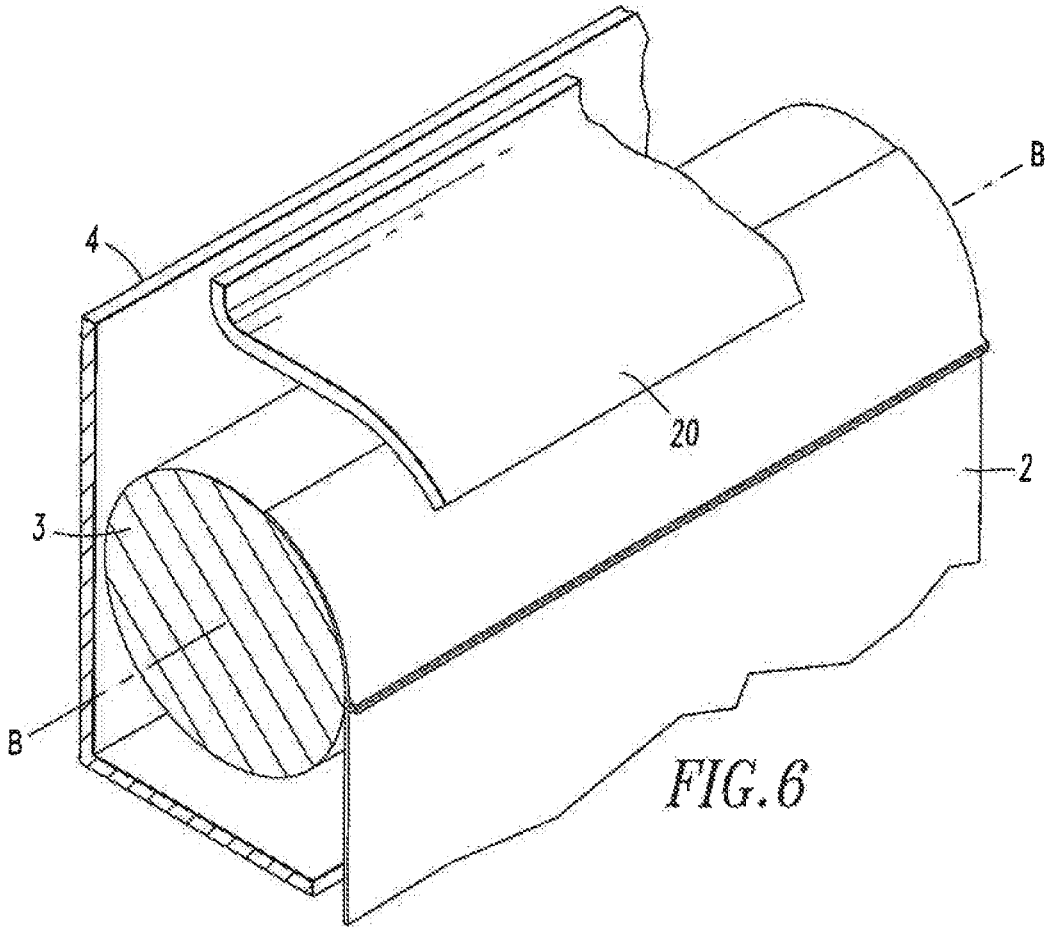
FIG. 6 is a sectional view taken along the lines of VI-VI in FIG. 1.

Referring to FIG. 6, I further prefer to provide a follower attached to the headrail which lays on the window covering material 2 as it is wound on the roller. The follower keeps the tabs 14 and pleats 16 parallel with one another and with the longitudinal axis BB of the roller. When the window covering material 2 is fully lowered the tabs provide some strength to the material counteracting any tendency for the material to sag or stretch unevenly.

Figure 7:
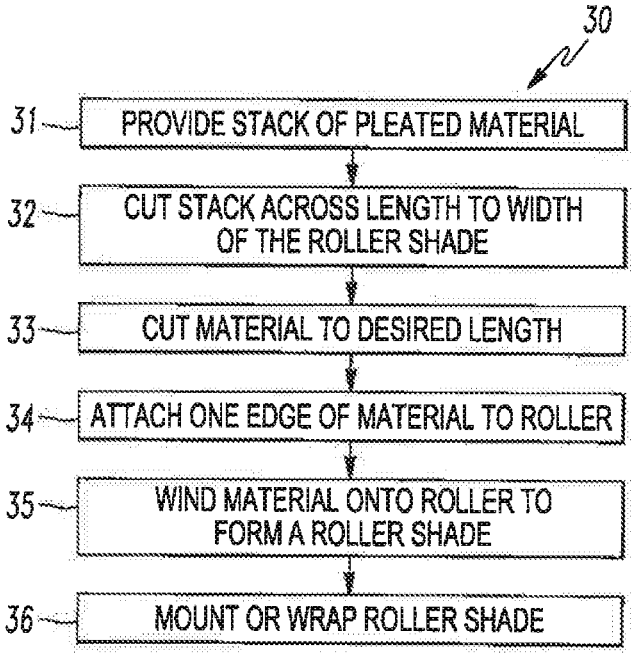
FIG. 7 is a flow chart of the steps used to make the roller shade shown in FIGS. 1 through 6.

Referring to FIG. 7 the fabrication process 30 begins with providing a stack of pleated material as indicated by box 31. Preferably the stack of pleated material has been made from strips bonded together as described above. Consequently, the tabs in the panel of pleated material will be along one edge of the stack and the pleats will be along the opposite edge of the stack. The fabricator or the manufacturer of the window covering material may trim the tabs so that they have a narrower width. The stack of window covering material will have a length when expanded that corresponds to the length of the roller shade to be made, the fabricator merely cuts the stack across its length as indicated by box 32. If the stack of material when expanded is longer than the length of the roller shade to be made, the fabricator must also cut the material to the desired length 33. Fabric can be cut on relatively narrow tables compared to regular shade tables since the length of the shade is simply counted out in pleats and the width can be cut with a shear that is just wider than the stack. Either the length or the width can be cut first or the material can be notched with a rough cut and then the cut out piece can be precisely sized (recut). Next the fabricator attaches one edge of the material to the roller at step 34 and winds the material onto the roll at step 35 to form a shade. During winding, the fabricator makes sure that the window covering material rolls evenly and that the tabs are all bent in the same direction on the roll. This stage should have some means to make sure the material is rolled up evenly. That may just be extra care by the worker. A bottom hem can be formed along one edge of the fabric before or after attaching to the roller in any of the conventional methods. To finish the shade the fabricator mounts the roller with the window covering material in a headrail or wraps the product in paper to establish memory at step 36.

A fabricator should see a significant advantage of this roller shade is the substantial cost savings in manufacture and shipment of the product. There will be significant savings in shipping and handling because the fabricator is working with boxes and stacks of material rather than rolls of material. The fabric segments which form the stack of the window covering material can be purchased in rolls having a width equal or greater to the width of the strips which encompasses most available fabrics. A manufacturer of pleated layers will ship stacks of fabric with different dimensions in boxes that are easily handled and stored on ordinary shelving and require very simple equipment for sizing. The fabric stacks are easy to store and ship and take much less room than rolls of fabric. The manufacturer can have specialized equipment for handling rolls and can take rolls of fabric of almost any size, cut the fabric into narrow widths, then remove flaws and then convert the fabric into very wide 12 foot layers. Common widths of many woven goods are 36", 45", 54", 60", 72" and 96" (which is much less common). Supply is more competitive in narrower widths. Because the width of the shade to be fabricated is determined by the length of the stack rather than the width of the fabric on a roll, there is no limit to the width of the roller shade which can be made up to the length of the stack. Should a flaw or broken thread appear in the fabric as it is being taken off the roll to be made into the stack, that portion of the material can be cut out and discarded. The waste will be much less than if a comparable shade had been made from a roll fabric having the same width as the shade.

The window covering material can alternatively be formed from a sheet of material in which microtabs have been formed. Strips are folded and the continuous beads of adhesive can be applied at spaced apart intervals along the strip. Then the strip is stacked and bonded on top of the previously laid down strip in the stack to form an accordion pleat. Tabs or microtabs are then formed at the glue lines. If desired the tabs may be cut or sanded to make them smaller. Typically this material removal process will be done when the panel has been folded into a stack that has all of the tabs on one side of the stack.

While I have shown certain present preferred embodiments of my roller shade and method of making that shade, it should be distinctly understood that the invention is not limited thereto but may be variously embodied in the scope of the following claims.

I claim:

1. A method of forming a roller shade from a stack of pleated material, said method comprising:

providing a stack of pleated material, the material being pleated in alternating accordion-type pleats;

cutting the stack of pleated material to a desired width;

coupling the stack of pleated material to a roller having a length substantially equal to the desired width of the roller shade; and unstacking the stack of pleated material and rolling the pleated material onto the roller to form the roller shade, wherein the pleated material has a substantially planar profile between adjacent pleats of the accordion-type pleats when the pleated material is un-stacked and unrolled from the roller to an extended position.

2. A method as in claim 1, wherein said stack of pleated material is formed from strips bonded together.

3. A method as in claim 1, wherein:

the stack of pleated material is cut when the stack of material is in a stacked configuration, and when the pleated material is in the stacked configuration, a first plurality of pleats of the accordion-type pleats are positioned along one edge of the stack of pleated material and a second plurality of pleats of the accordion-type pleats are positioned along an opposed edge of the stack of pleated material.

4. A method as in claim 1, wherein coupling the stack of pleated material to a roller comprises coupling an edge of the material widthwise along the length of the roller.

5. A method as in claim 1, wherein the stack of pleated material is stored in a stacked pleated configuration and cut in the stacked pleated configuration.

6. A method of forming a roller shade from a stack of pleated material, said method comprising:

providing material for the roller shade in a stacked configuration with the material being pleated in alternating accordion-type pleats;

coupling a free end of the stack of pleated material to a roller having a length substantially equal to a desired width of the roller shade; and unstacking the stack of pleated material and rolling the pleated material onto the roller to form the roller shade, wherein the pleated material has a substantially planar profile between adjacent pleats of the alternating accordion-type pleats when the pleated material is un-stacked and unrolled from the roller to an extended position.

7. A method as in claim 6, wherein the stack of pleated material is formed from a plurality of strips coupled together.

8. A method as in claim 7, wherein the strips are bonded together at adjacent edges of the strips.

9. A method as in claim 7, wherein each strip is pleated such that a single pleat of the alternating accordion-type pleats is formed between opposed edges of the strip.

10. The method of claim 9, wherein the single pleat is positioned equidistant from the opposed edges of the strip.

11. A method as in claim 7, wherein edges of adjacent strips of the plurality of strips are coupled together such that the coupled edges extend perpendicular to a plane defined by the roller shade when in a deployed position.

12. A method as in claim 7, wherein:

edges of adjacent strips of the plurality of strips are coupled together such that the coupled edges form a tab extending across the width of the roller shade; and the tab forms a structural element that opposes a tendency of the roller shade to curl toward the roller when the roller shade is moved to a deployed position.

13. A method as in claim 7, wherein:

the alternating accordion-type pleats comprise a plurality of first pleats formed along one face of the pleated material and a plurality of second pleats formed along an opposed face of the pleated material;

each of the first plurality of pleats is formed between opposed edges of a given strip of the plurality of strips; and each of the second plurality of pleats corresponds to a tab formed between edges of adjacent strips of the plurality of strips.

14. A method as in claim 13, wherein, when the pleated material is in the stacked configuration, the first plurality of pleats are positioned along one edge of the stack of pleated material and the second plurality of pleats are positioned along an opposed edge of the stack of pleated material.

15. A method as in claim 6, wherein the alternating accordion-type pleats extend parallel to one another and each pleat of the alternating accordion-type pleats extends parallel to a longitudinal axis of the roller.

16. A method as in claim 6, further comprising cutting the pleated material to a desired width corresponding to the desired width of the roller shade while the pleated material is in the stacked configuration.

17. A method as in claim 6, wherein rolling the pleated material onto the roller comprises moving the pleated material between the roller and a follower that presses the pleated material against the roller.

* * * * *